US009073192B2

(12) United States Patent
Rubin et al.

(10) Patent No.: US 9,073,192 B2
(45) Date of Patent: Jul. 7, 2015

(54) POCKET DRIVER TOOL

(71) Applicant: InterDesign, Inc., Solon, OH (US)

(72) Inventors: Bennett S. Rubin, Pepper Pike, OH (US); Richard C. Adamany, Chagrin Falls, OH (US)

(73) Assignee: INTERDESIGN, INC., Solon, OH (US)

( * ) Notice: Subject to any disclaimer, the term of this patent is extended or adjusted under 35 U.S.C. 154(b) by 102 days.

(21) Appl. No.: 13/942,194

(22) Filed: Jul. 15, 2013

(65) Prior Publication Data

US 2014/0016305 A1 Jan. 16, 2014

Related U.S. Application Data

(60) Provisional application No. 61/672,147, filed on Jul. 16, 2012.

(51) Int. Cl.

| | |
|---|---|
| ***B25B 23/18*** | (2006.01) |
| ***B25G 1/08*** | (2006.01) |
| ***B25B 15/00*** | (2006.01) |

(52) U.S. Cl.

CPC ..... *B25B 23/18* (2013.01); *B25G 1/085* (2013.01); *B25B 15/00* (2013.01)

(58) Field of Classification Search

USPC ..... 362/119; 81/177.4, 439, 490

See application file for complete search history.

(56) References Cited

U.S. PATENT DOCUMENTS

| | | | | |
|---|---|---|---|---|
| 1,309,281 | A | | 7/1919 | Forbes |
| 4,283,757 | A | | 8/1981 | Nalbandian et al. |
| 5,515,249 | A | | 5/1996 | Shiao |
| D385,172 | S | | 10/1997 | Bramsiepe et al. |
| 5,704,260 | A | | 1/1998 | Huang |
| 5,772,308 | A | | 6/1998 | Lin |
| 5,782,150 | A | | 7/1998 | Huang |
| D400,775 | S | | 11/1998 | Hsu |
| 5,842,777 | A | * | 12/1998 | McDermott ..... 362/205 |
| 5,887,306 | A | | 3/1999 | Huang |
| 5,896,606 | A | | 4/1999 | Huang |
| 5,967,641 | A | | 10/1999 | Sung et al. |
| 6,027,224 | A | * | 2/2000 | Schnell ..... 362/119 |
| 6,216,858 | B1 | | 4/2001 | Chiu |
| 6,431,034 | B1 | | 8/2002 | Chen |
| 6,640,675 | B1 | | 11/2003 | Chuang |
| 6,739,224 | B1 | * | 5/2004 | Wershe ..... 81/437 |
| 7,032,483 | B2 | | 4/2006 | Liu |
| D580,655 | S | | 11/2008 | Kao |
| D592,930 | S | | 5/2009 | Cai |
| D705,636 | S | * | 5/2014 | Rubin et al. ..... D8/85 |
| 2007/0251355 | A1 | | 11/2007 | Kao |
| 2008/0041746 | A1 | | 2/2008 | Hsiao |
| 2008/0083304 | A1 | | 4/2008 | Finn |
| 2011/0063820 | A1 | * | 3/2011 | Wang ..... 362/120 |
| 2011/0226098 | A1 | | 9/2011 | Zhang |

* cited by examiner

*Primary Examiner* — Evan Dzierzynski

(74) *Attorney, Agent, or Firm* — D. Peter Hochberg; Sean F. Mellino

(57) ABSTRACT

A pocket driver tool having a longitudinal housing with a multisided socket at one end of the tool and extending along part of a longitudinal axis of the pocket driver tool, and stalls for drivers extending transversely to the longitudinal axis. A lumination device can illuminate the work place in which the pocket driver tool is to drive a fastener into or out of a workpiece.

24 Claims, 14 Drawing Sheets

POCKET DRIVER TOOL

BACKGROUND OF THE INVENTION

1. Field of the Invention

This invention relates to miniature tools and, in particular, to pocket driver tools for storing and providing both a holder for drivers and a handle for operating the drivers, and to such pocket driver tools having illuminating devices.

2. Description of the Prior Art

U.S. Pat. No. 4,283,757 (Nalbandian et al., 1981), U.S. Pat. No. 5,515,249 (Shiao, 1996), U.S. Pat. No. 5,772,308 (Lin, 1998) and D592,930 (Cai, 2009) all disclose illuminated screw drivers. A number of screw driver tools are known incorporating storage compartments for the drivers, but where the socket is not on the longitudinal axis of the tool. Tools are known having storage compartments where drivers or other components are stored in the tool, but where the drivers or other components are not transverse to and are disposed on the longitudinal axis of the tool, including U.S. Pat. No. 5,515,249 (Shiao, 1996), U.S. Pat. No. 5,967,641 (Sung et al., 1999), U.S. Pat. No. 6,216,858 (Chiu, 2001), U.S. Pat. No. 6,431,034 (Chen, 2002), U.S. Pat. No. 6,640,675 (Chuang, 2003), U.S. Pat. No. 7,032,483 (Liu, 2006), U.S. Design Pat. No. Des. 385,172 (Bramsiepe et al., 1997), and U.S. Patent Publications Nos. 2008/0083304 (Finn) and 2011/0226098 (Zhang). U.S. Pat. No. 1,309,281 (Forbes, 1919) discloses a tool whose handle is also a tool kit. Other disclosures of driver tools for holding more than one driver can be found in U.S. Pat. No. 5,704,260 (Huang, 1998), U.S. Pat. No. 5,782,150 (Huang, 1998), U.S. Pat. No. 5,887,306 (Huang, 1999), U.S. Pat. No. 5,896,606 (Huang, 1999), U.S. Publication Nos. 2007/0251355 (Kao, 2007) and 2008/0041746 (Hsiao), and U.S. Design Pat. Des. 385,172 (Bramsiepe et al., 1997), Des. 400,775 (Hsu, 1998), D580,655 (Kao, 2008) and D592,930 (Cai, 2009). Included in the foregoing are disclosures of such driver tools for holding a plurality of drivers that also have work-place illumination devices, such as U.S. Pat. No. 5,515,249 (Shiao, 1996) and U.S. Pat. No. 5,772,308 (Lin, 1998). An illuminated screwdriver is described in U.S. Pat. No. 4,283,757 (Nalbandian et al., 1981). The assignee of the present application has on the market a product called "XDrive Compact Driver Tool" wherein drivers are stored in the tool and extend in directions that are parallel with the longitudinal axis of the tool.

SUMMARY OF THE INVENTION

An object of the invention is to provide a driver tool that is small enough to be stored in a user's pocket, perhaps on a key chain, in a handbag, attached to a handle or other part of a larger object, or stored in a desk, tool box, accessory box or the like.

Another object of the present invention is to provide a pocket driver tool which can store a plurality of drivers in a compact, secure but easily accessible manner.

A further object of the present invention is the provision of a pocket driver tool for holding elongated drivers having a working end and a holding end, the working end being a socket into which drivers can be inserted.

It is also a provision of the present invention to provide a pocket driver tool as discussed above having an illumination device for selectively illuminating a work place.

A yet further object of the present invention is to provide a pocket driver tool with an illumination device which fully illuminates a work place.

It is also an object of the present invention to provide a pocket driver tool which is extremely thin, while still being able to store a plurality of drivers and cell batteries for powering an illumination device forming part of the pocket driver tool.

An additional object of the invention is to provide a pocket driver tool with an illumination device having an easily accessible actuating button.

It is yet still another object of the invention to provide a pocket driver tool which is of short length, of narrow width and being flat across its broader surfaces, yet is still able to perform its intended function.

A general object of the present invention is to provide a pocket driver tool which is efficient and effective in operation, is attractive in appearance and can be produced in a precise manner at a low cost.

These and other objects will be apparent from the description to follow and from the appended claims.

DESCRIPTION OF THE PREFERRED EMBODIMENT

Figure 1:
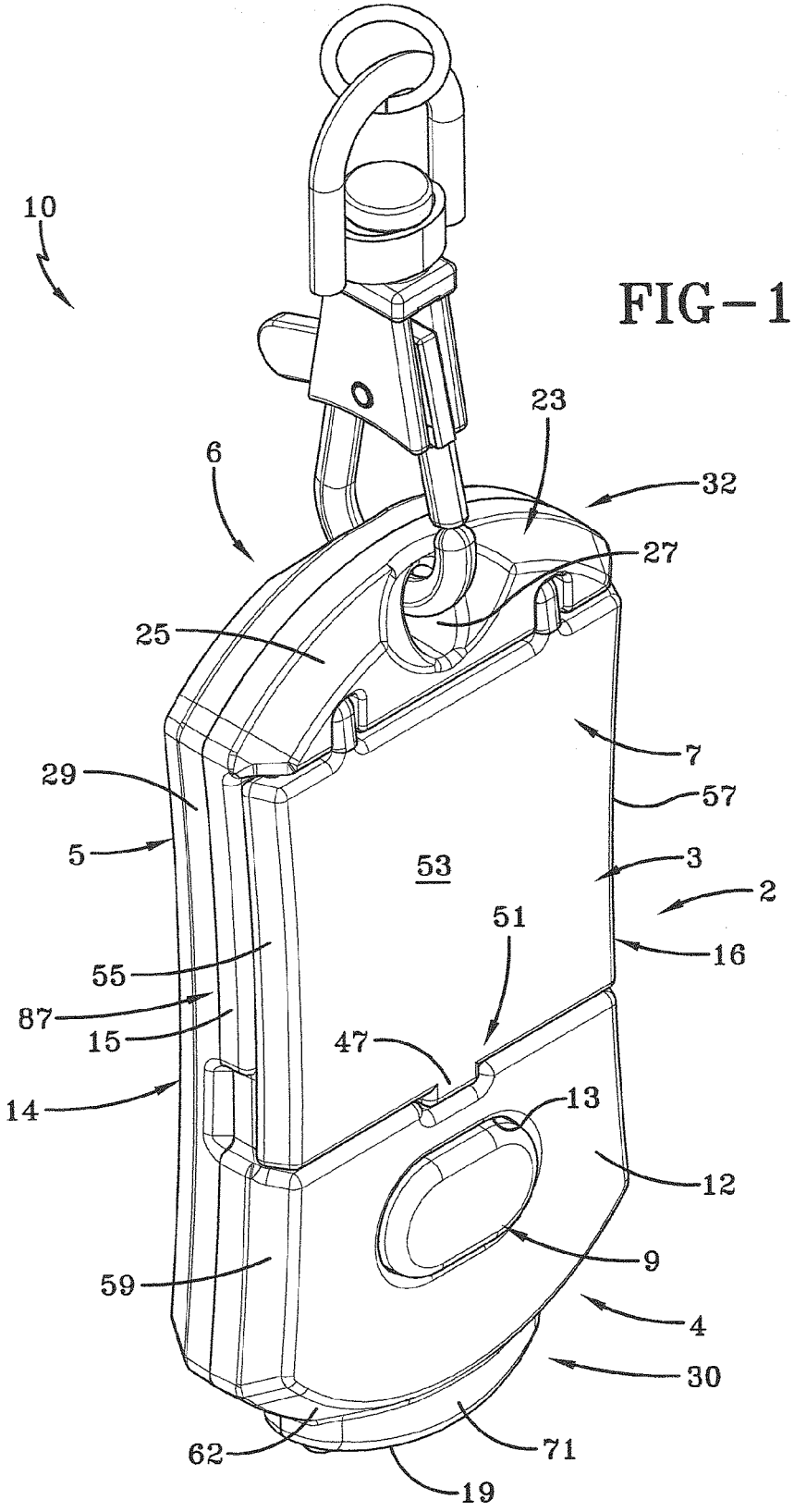
FIGS. 1 and 2 are perspective views of a pocket driver tool according to the preferred embodiment of invention, showing the front and rear portions thereof in a vertical position with the forward end of the pocket driver tool disposed at the lower part of the respective figures, with a spring clip which is not a component of the preferred embodiment.
Figure 2:
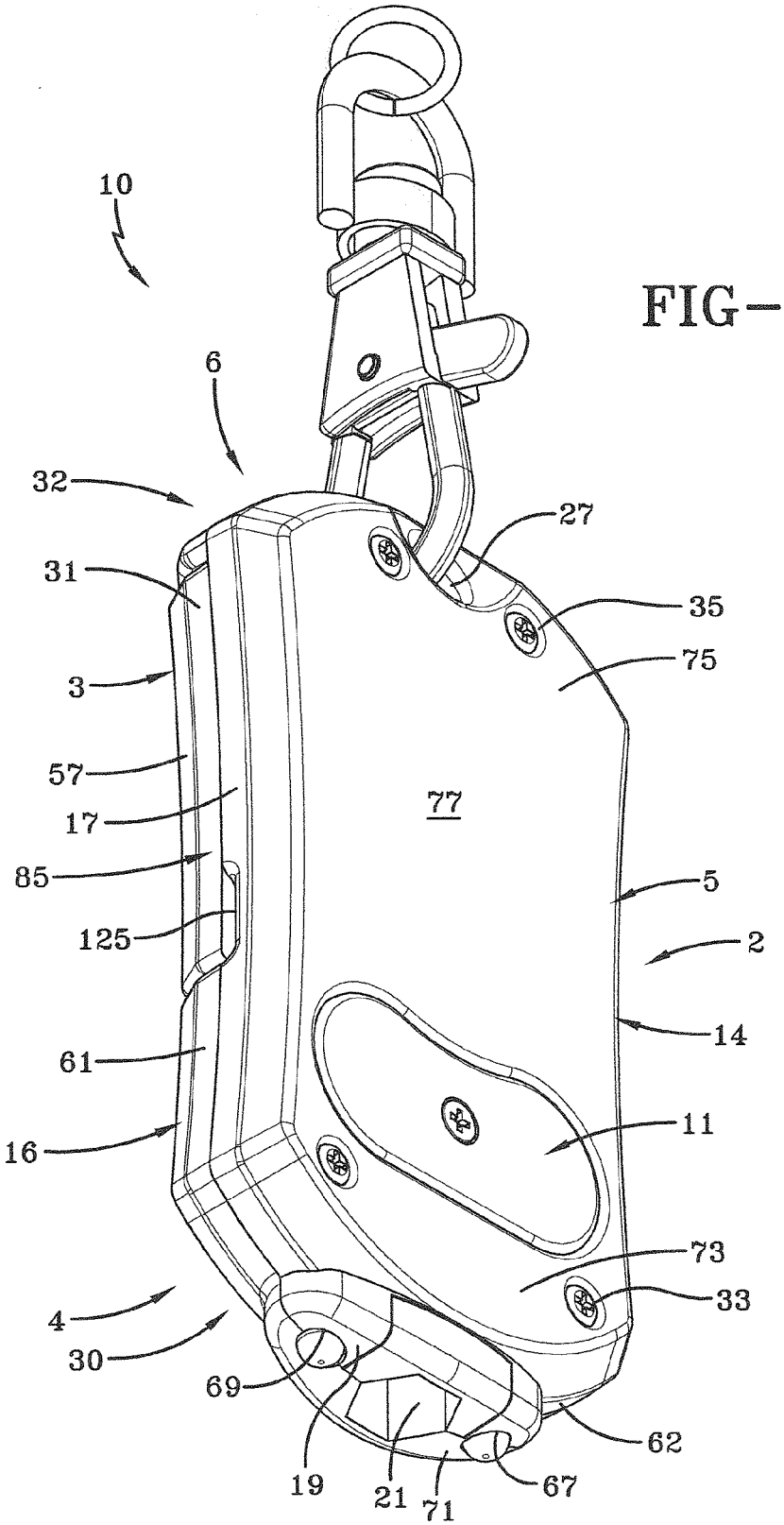
Figure 3:
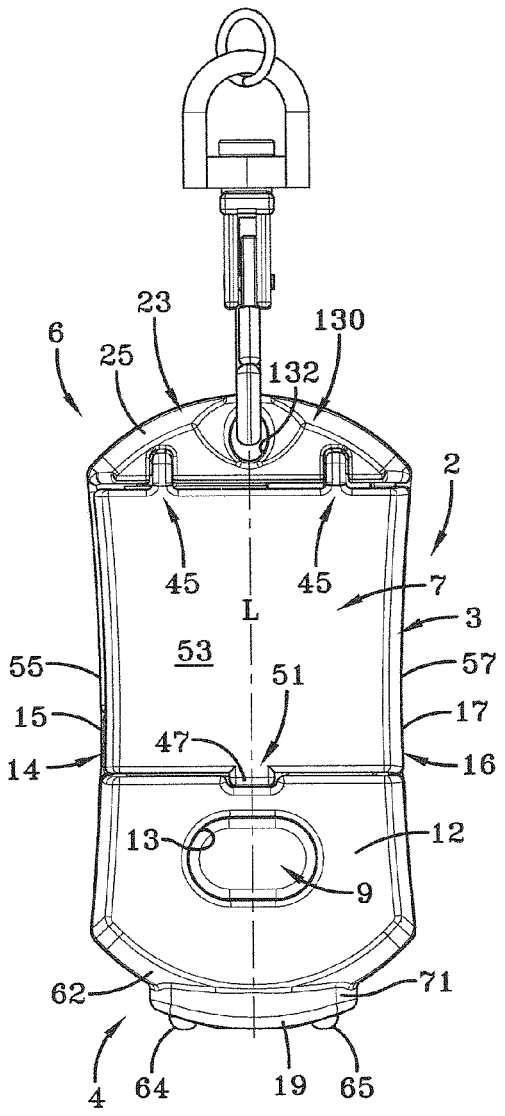
FIGS. 3 and 4 are respective front and back views of the embodiment of the invention shown in FIGS. 1 and 2.
Figure 4:
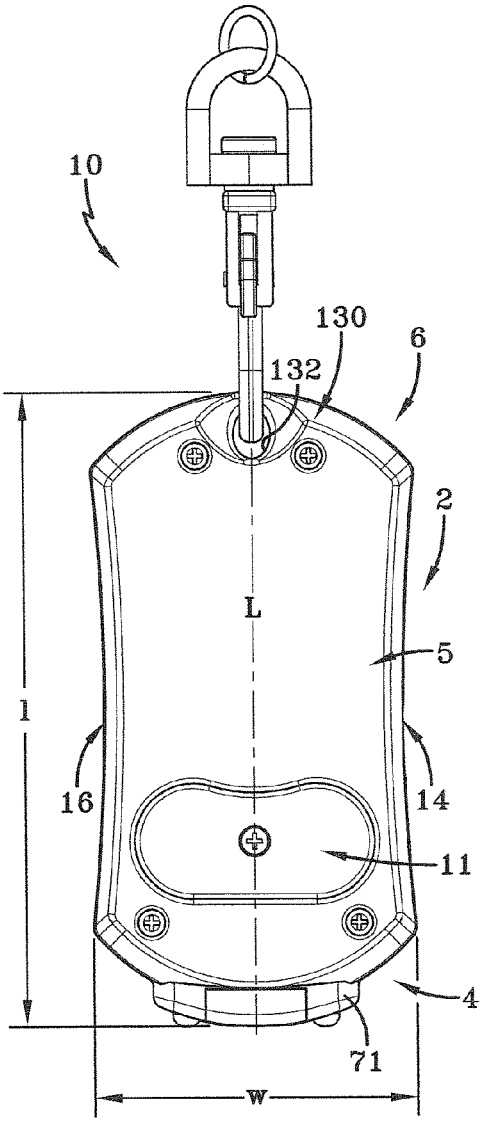
Figure 5:
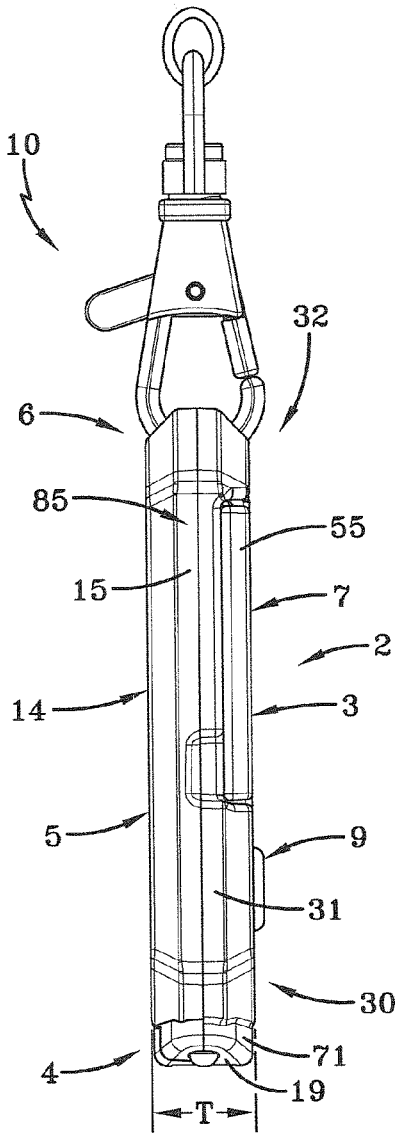
FIGS. 5 and 6 are respective views of opposite sides of the preferred embodiment of the invention shown in FIGS. 1-4.
Figure 6:
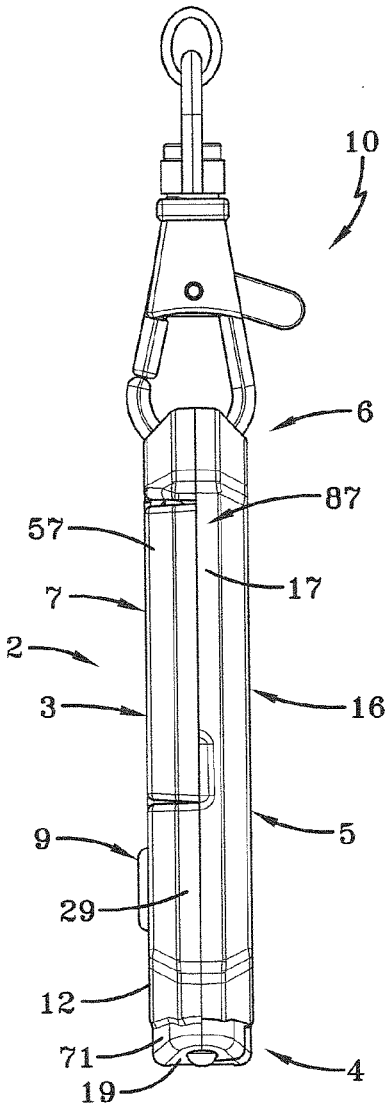
Figure 7:
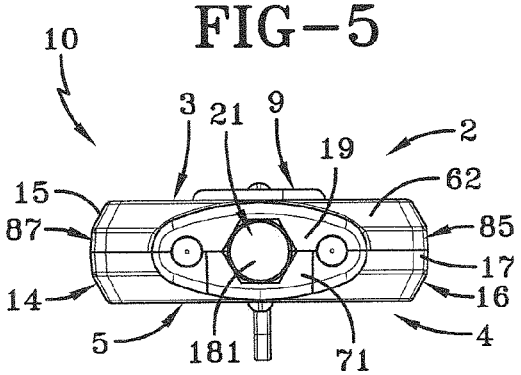
FIGS. 7 and 8 are respective forward and rearward views of the preferred embodiment of the invention as shown in FIGS. 1-6.
Figure 8:
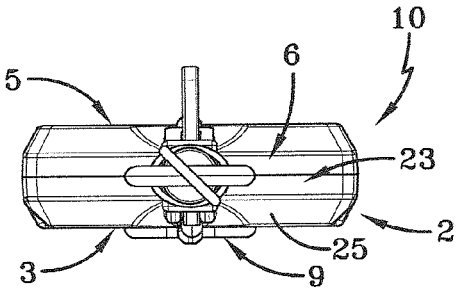
Figure 9:
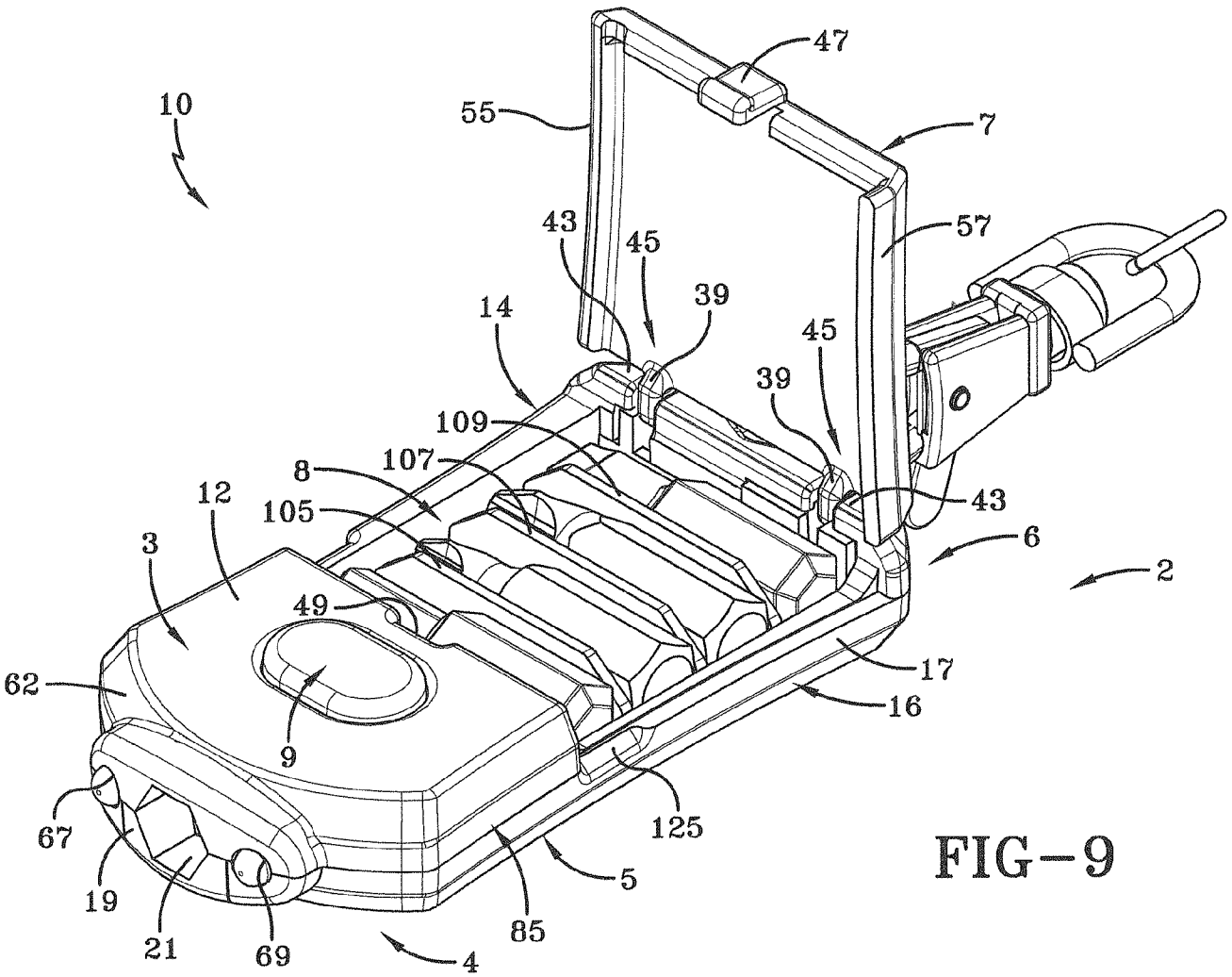
FIG. 9 is a perspective view of the preferred embodiment of the invention as shown in FIGS. 1-8, with the storage compartment cover in its open position revealing the drivers in their respective stalls.
Figure 10:
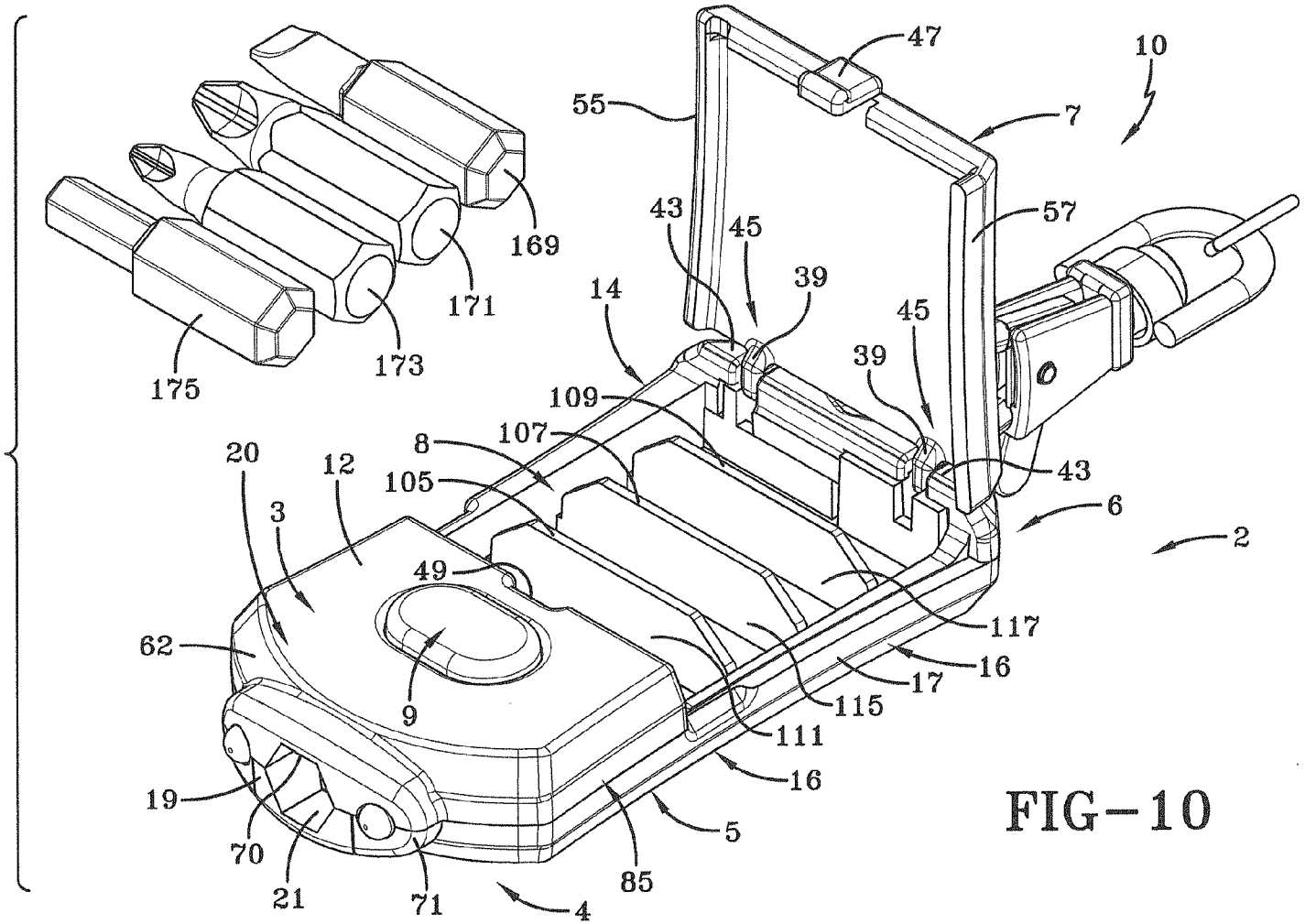
FIG. 10 is a perspective view like that shown in FIG. 9 with the drivers raised above the pocket driver tool.
Figure 11:
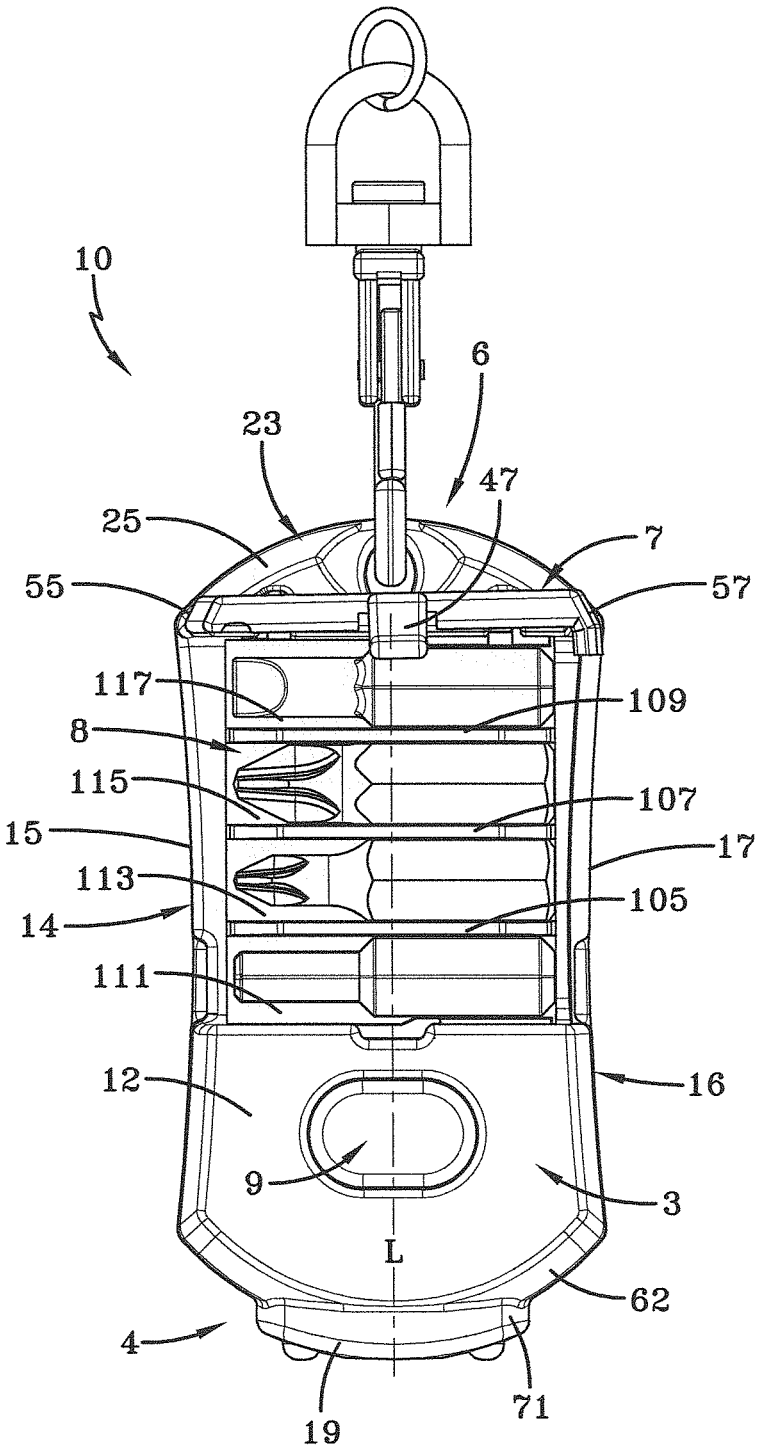
FIGS. 11, 12 and 13 are front, side and forward views of the preferred embodiment of the invention shown in FIGS. 1-10 with the storage compartment cover in its open position.
Figure 12:
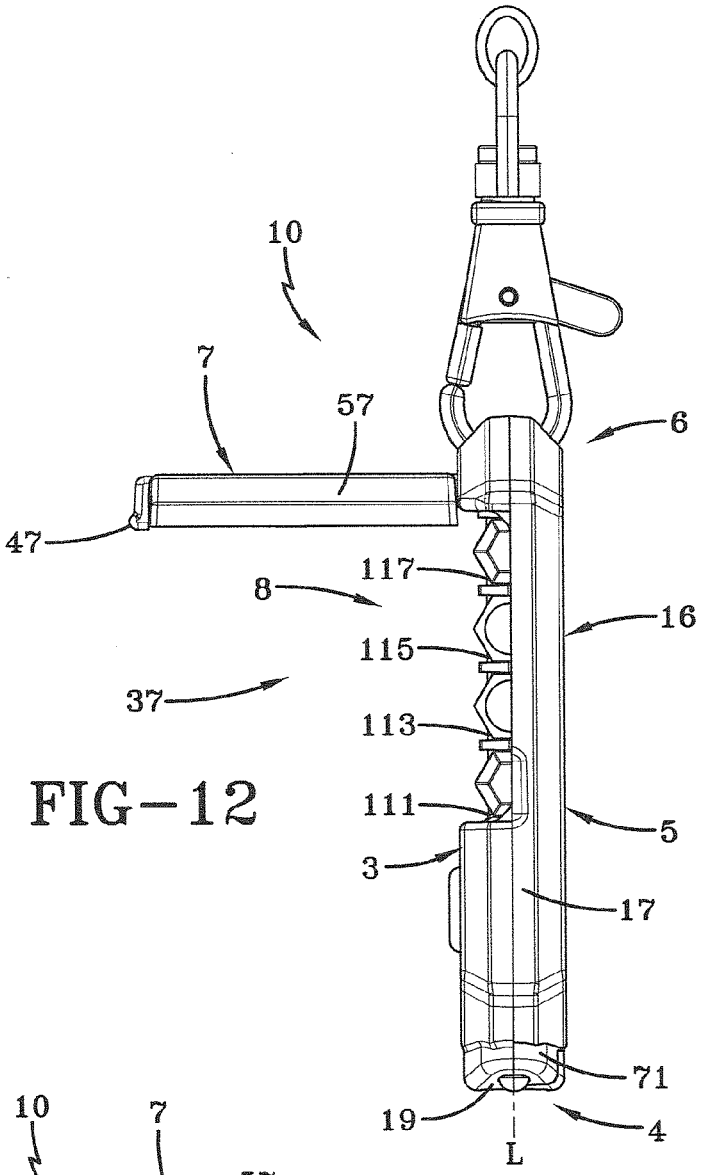
Figure 13:
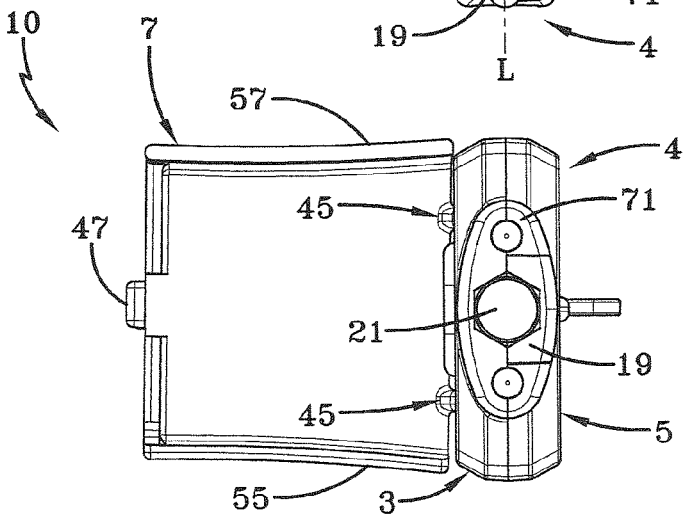
Figure 14:
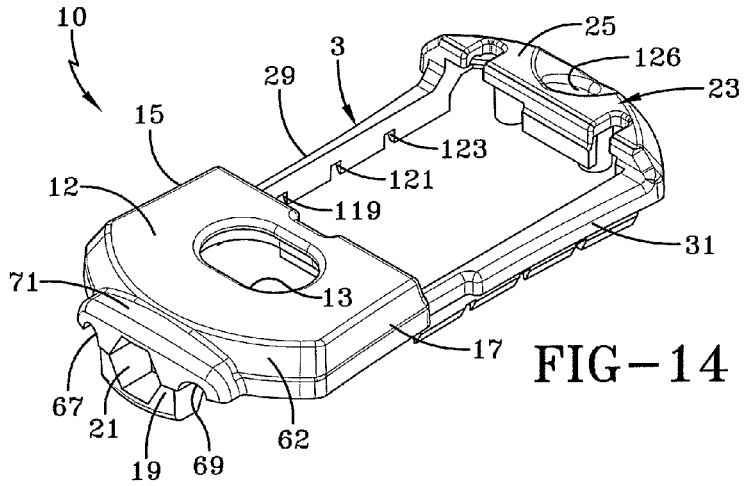
FIGS. 14, 15, 16, 17 and 18 are perspective, front, side, rear and forward end views of a housing top used in the preferred embodiment of the invention shown in FIGS. 1-13.
Figure 15:
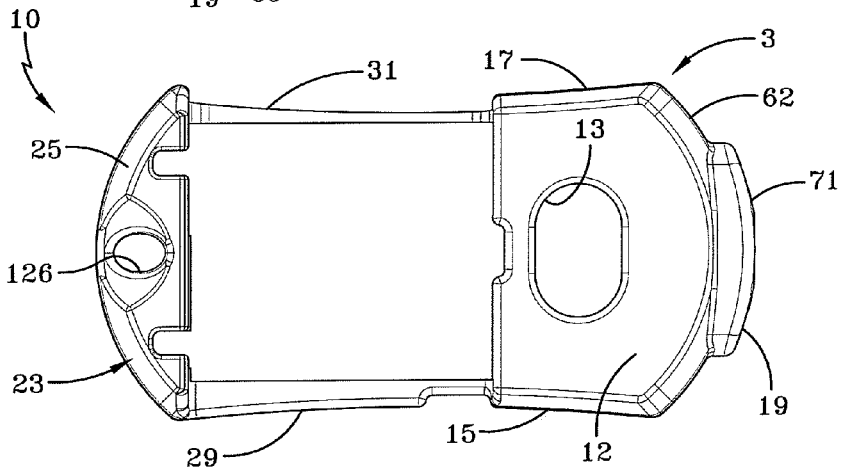
Figure 16:
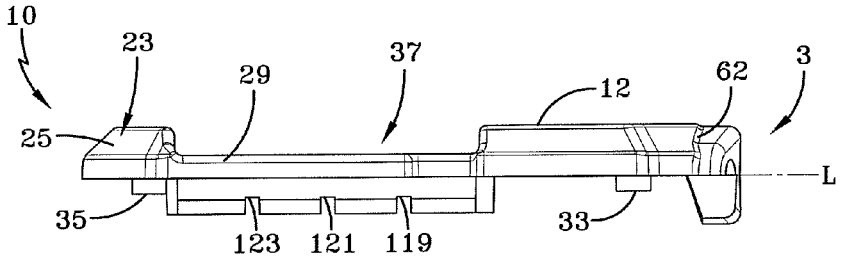
Figure 17:
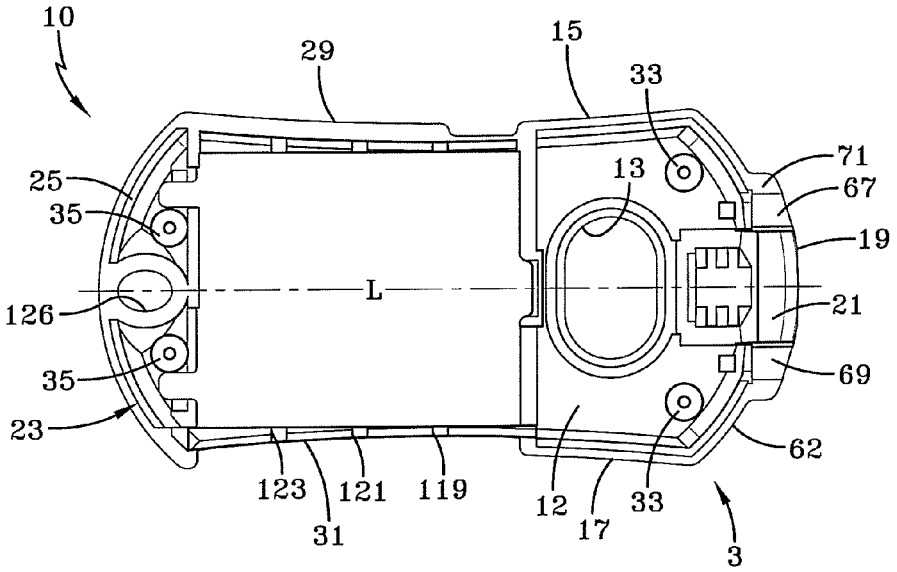
Figure 18:
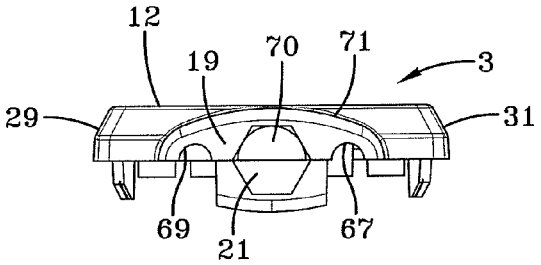
Figure 19:
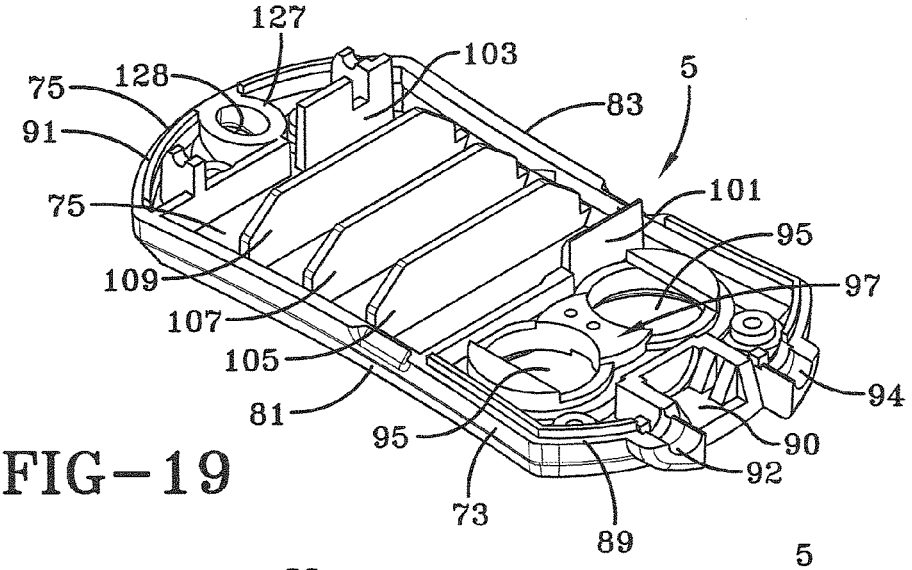
FIGS. 19, 20, 21, 22 and 23 are perspective, front, side, rear and forward end views of a housing bottom used in the preferred embodiment of the invention shown in FIGS. 1-13.
Figure 20:
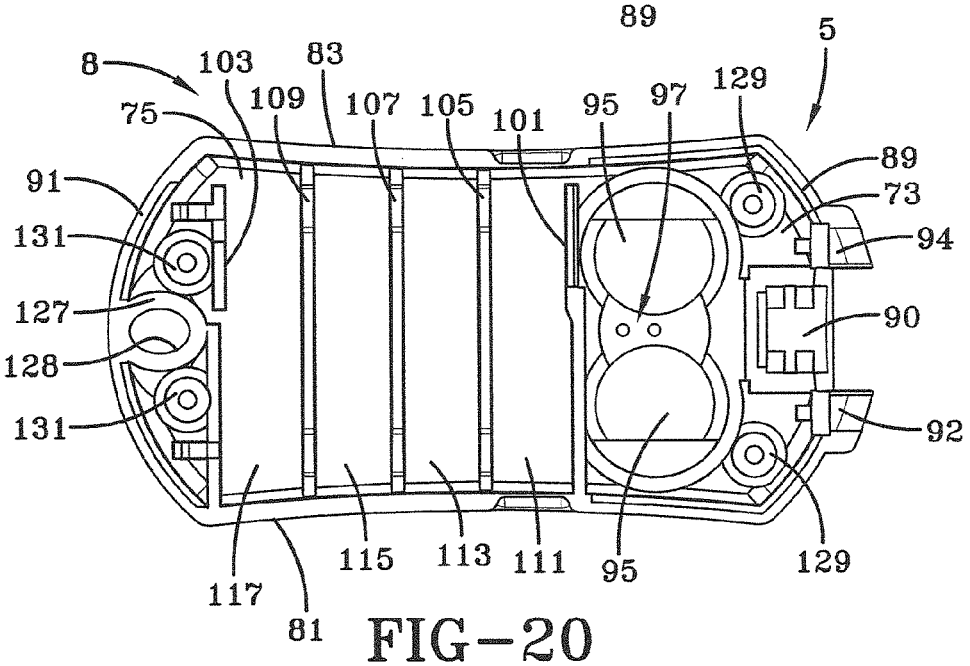
Figure 21:
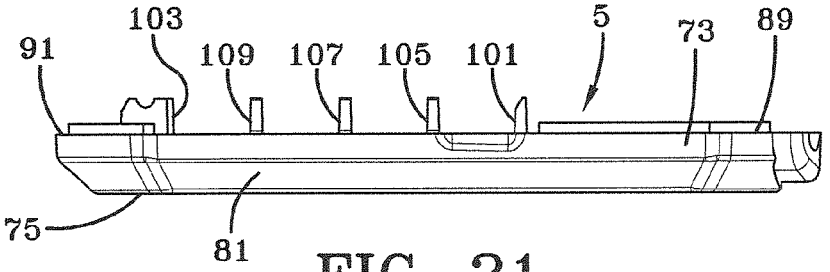
Figure 22:
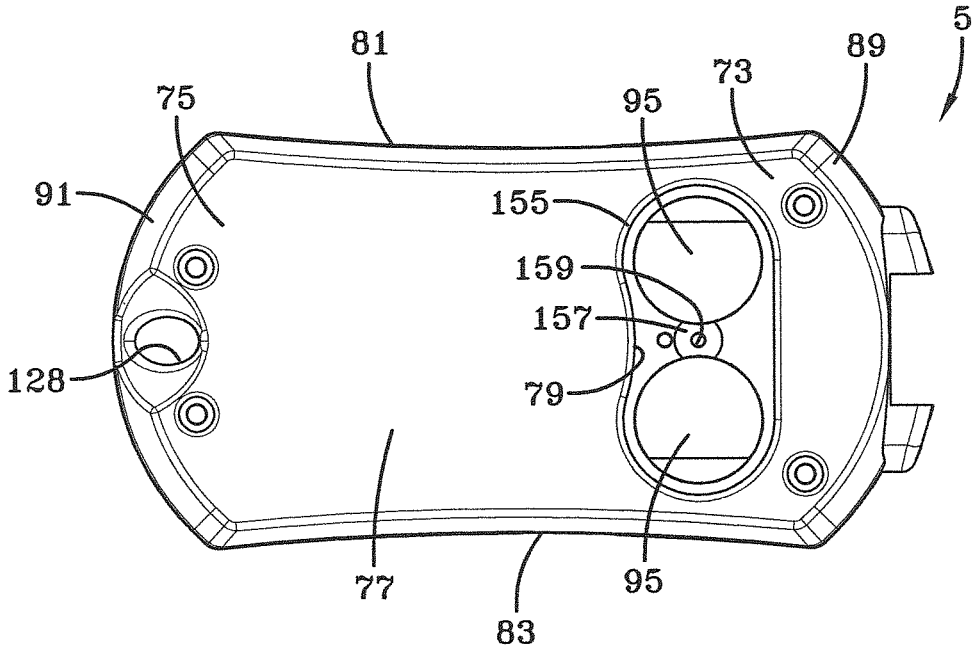
Figure 23:
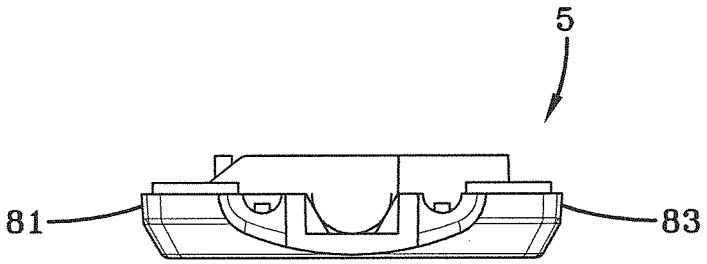

The foregoing objects of the invention are accomplished by means of the preferred embodiment of the invention discussed below. A pocket driver tool 10 is shown in FIGS. 1-13 and 27. Pocket driver tool 10 includes a longitudinal housing 2 composed of a housing top 3 and a housing bottom 5. Pocket driver tool 10 further includes a removable tool door 7 for opening and closing a driver storage compartment 8, an illumination device actuating button 9 and a battery door 11 as most of its externally visible parts. Pocket driver tool 10 has a central longitudinal axis L. Housing 2 has a forward end portion 4, a rearward end portion 6, and opposing side portions 14 and 16. Housing top 3 is composed of a flat front face 12, with an actuating button orifice 13, generally flat (although slightly concave and slightly outwardly flared with respect to longitudinal axis L) opposing side walls 15, 17, a housing top, slightly convex forward end wall 19 and a forward socket and portion 20 including a multisided socket 21 which is preferably a hexagonal socket 21. Axis L is the central longitudinal axis of socket 21. Housing top 3 has a housing top curved rearward section 23 with a convexly curved, housing top rearward end wall 25 and a key ring-receiving orifice 27 having an imaginary axis perpendicular to longitudinal axis L. A pair of opposing housing top side walls 29, 31 interconnects a forward section 30 of housing top 3 and rearward section 32 of housing top 3. Respective forward and rearward screw bosses 33 and 35 include threaded screw holes for receiving screws to construct pocket tool holder 10 as discussed below. Housing top 3 is depicted in detail in FIGS. 14-18.

Tool door 7 is positioned over a tool storage opening 37 in housing top 3. Tool door 7 has a pair of hinge arms 39 having outwardly extending hinge pins 41 which are received in receptacle bosses 43 in housing top 3 to form a pair of hinges 45. Tool door 7 also has a latch arm 47 and housing top 3 has a latch receptacle 49, latch arm 47 and latch receptacle 49 forming a snap latch 51. Tool door 7 has a flat front face 53 and opposing side walls 55 and 57 which cooperate with parts of the respective opposing sides portions 14 and 16 of pocket driver tool 10 as discussed below.

Housing top 3 includes on its front face 12 a pair of opposing side walls 59 and 61 of which side walls 55 and 57 of tool door 7 are respective continuations to provide this portion of pocket driver tool 10, a continuous and sleek appearance. Opposing side walls 59 and 61 also cooperate with the side walls of housing bottom 5 as explained hereinbelow. Side walls 55, 57, 59 and 61 are slightly concave with respect to longitudinal axis L as explained below. Housing top 3 has a convexly curved housing top forward end wall 62 opposite rearward end wall 25. Pocket driver tool 10 includes an illumination device 200. Illumination device 200 is located at forward socket end portion 20. Forward section 30 of housing top 3 further includes upper portions 64 and 65 of a pair of lens mounts 67 and 69 on opposite sides of an upper socket portion 70 of socket 21 for, as explained below, directing illumination to the work place for a driver inserted in socket 21. Socket 21 and lens mounts 67, 69 are located in a forwardly extending nose portion 71 further discussed below.

Reference is now made to housing bottom 5 which is attached to housing top 3 as discussed later. The details of housing bottom 5 are shown in FIGS. 19-22. Housing bottom 5 has a forward portion 73 and a rearward portion 75. Housing bottom 5 includes a housing bottom flat back face 77 with a battery door orifice 79, opposing housing bottom side walls 81 and 83 which correspond in configuration (including the concave curve and the outward flare) to opposing housing top side walls 15 and 17 of housing top 3 to form, when housing top 3 and housing bottom 5 are attached, continuous, closed sleek and attractive opposing sides 85 and 87 of pocket driver tool 10. Housing bottom 5 further includes a convexly curved, housing bottom forward end wall 89 and a convexly curved, housing bottom rearward end wall 91, each configured to match and be continuous of respective forward and rearward end wall 62 and 25 of housing top 3 to also form respective continuous, closed sleek forward and rearward end walls 19 and 25 of pocket driver tool 10. Housing bottom 5 includes in its forward portion 73 a lower socket portion 90 and a pair of lower portions 92 and 94 of lens mounts 67 and 69. A pair of cell battery compartments 95 is in forward portion 73, but rearward of lower socket portion 90 and lower portions 92 and 94. A PCB-LED compartment 97 has appropriate walls to firmly support a PCB-LED assembly 99 as explained further. Extending between side walls 81 and 83 are opposing forward driver end stall wall 101 and rearward driver stall end wall 103, and three intermediate driver stall walls 105, 107 and 109, for forming a series of driver stalls 111, 113, 115 and 117. Driver stalls 111, 113, 115 and 117 are transverse to longitudinal axis L. Housing top 3 has in the bottom of its side walls 31 and 33, a set of opposing slots 119, 121 and 123 for receiving the upper ends of driver stall walls 105, 107 and 109. Housing bottom 5 also has a finger slot 125 to enable a user to slip the end of the user's finger in slot 125 to open tool door 7. Tool door 7 thus selectively covers and uncovers driver stalls 111, 113, 115 and 117. This enables the withdrawal of one or more drivers from said respective driver stalls and for enabling the putting of drivers in driver stalls when the stalls are empty. Housing bottom 5 has in its housing bottom rearward portion 75 a centrally located boss 127 with a portion 128 of key ring-receiving orifice 27 having an imaginary axis which is perpendicular to longitudinal axis L. Housing bottom rearward portion 75 and housing top rear section 23 cooperate to form a rear housing portion 130. Key ring-receiving orifice 27 has a portion 126 of housing top 3 and portion 128 of key ring-receiving orifice 27 of housing bottom 5 are in alignment and cooperate to form housing key ring-receiving orifice 27. Housing bottom 5 further is further comprised of forward screw hole bosses 129 and rearward screw hole bosses 131, each located symmetrically of longitudinal axis L for cooperating with respective tool bosses 33 and 35 in housing top 3 to receive screws in their respective screw holes for holding housing top 3 and housing bottom 5 together.

PCB-LED assembly 99 includes a base 133 from which extend a set of electrical leads 135 to which are connected light emitting diodes (LEDs) 137. A mounting block 139 also extends from base 133 with a button protrusion 141 to be engaged by button 9 as explained below. LEDs 137 are respectively disposed in the rearward portions of lens mounts 67 and 69. LEDs 137 are preferably 10,000 MCD, 50,000 LED bulbs for two hours of continuous use.

Figure 24:
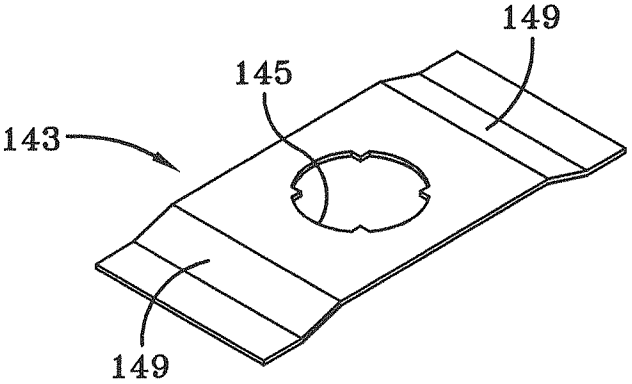
FIG. 24 is a perspective view of a battery contact for use in the preferred embodiment of the invention.
Figure 27:
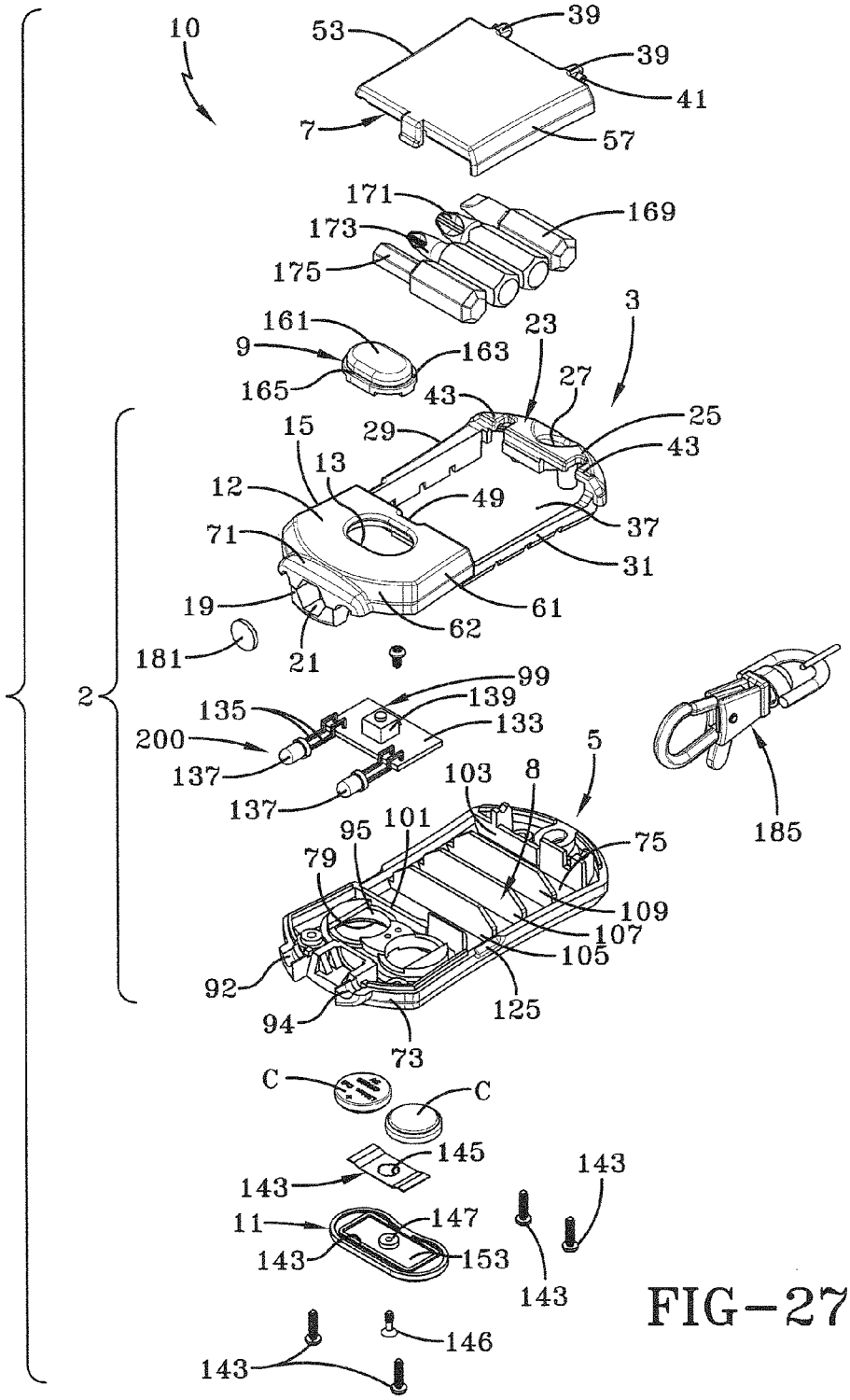
FIG. 27 is an exploded view of the preferred embodiment of the invention as shown in FIGS. 1-23.

A battery contact 143, shown alone in FIG. 24, is disposed between battery door 11 and cell battery compartments 95 for electrically connecting cell batteries C when the latter are mounted in compartments 95. Battery contact 143 is made of an electrically conducting material such as a tin nickel alloy, and has a hole 145 in its mid-portion for receiving a captive screw 146 extending through a conical post 147 extending inwardly from the center of battery door 11, perpendicular to longitudinal axis L. Battery contact 143 has inwardly flared side portions 149 for being compressed against cell batteries C by battery door 11 to assure contact with batteries C. Batteries C are preferably 2 CR 1025 lithium batteries.

Battery door 11 has an interior battery contact lip 151 for pressing battery contact 143 against cell batteries C disposed in battery compartments 85, and a recess 153 for receiving a lip 155 in housing bottom 5 to firmly seat battery door 11 in housing bottom 5 across battery door orifice 79. Housing bottom 5 has a screw boss 157 with a screw hole 159 for receiving captive screw 146 to firmly and releasably attached battery door 11 to pocket driver tool 10.

Figure 25:
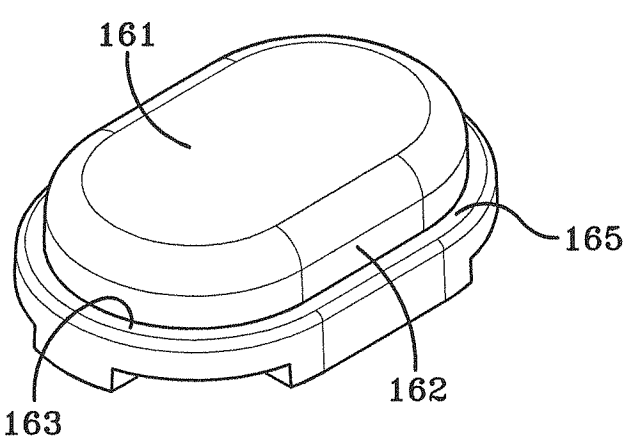
FIGS. 25 and 26 are respectively perspective and bottom plan views of an actuating button for use in the preferred embodiment of the invention.
Figure 26:
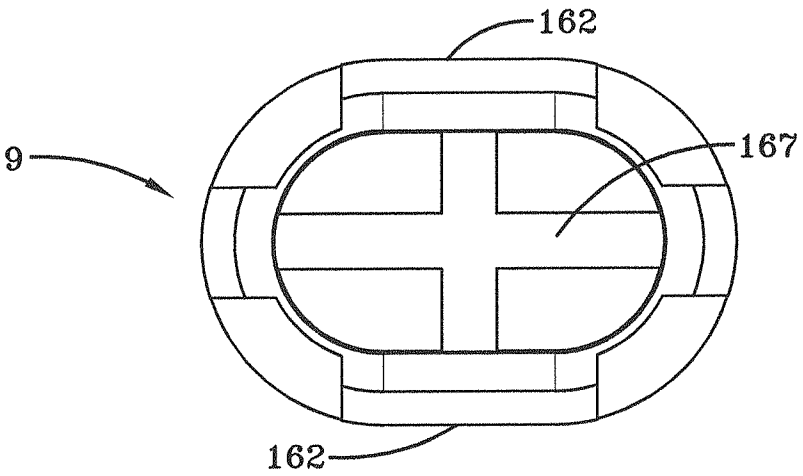

FIGS. 25 and 26 illustrate illumination device actuating button 9. Illumination device actuating button 9 has a generally oblong outer periphery with straight opposing sides 162, and a flat exterior face 161. It has a peripheral shoulder 163 on a lip 165 for engaging an interior shoulder on housing top 3 to retain button 9 in housing top 3. There is an interior recessed cross 167 for engaging button protrusion 141, which button 9 depresses to engage PCB-LED assembly 99 with cell batteries C to actuate LEDs 137.

Driver stalls 111, 113, 115 and 117 extend across driver tool compartment 8 perpendicular to longitudinal axis 11. The base of compartment 8 is the interior surface of the forward portion of housing bottom 5, and the top of compartment 8 is the interior surface of front face 53 of tool door 7. Driver tools found to be important to users of this type of tool are a flat head driver 169, a relatively large Phillips head driver 171, a relatively small Phillips head driver 173 and an Allen driver 175. The preferred forms of drivers other than a flat head driver are a #2 Phillips driver 177, a #1 Phillips driver 179 and a 5/32 inch Allen driver 175. These drivers are preferably 24.85 mm long. The driven end of each of drivers 169, 171, 173 and 175 are each preferably hexagonal as is socket 21, and have a cross dimension between the flats of 6.250 mm. Socket 21 is dimensioned to receive and drive drivers 169, 171, 173 and 175. The respective drivers 169, 171, 173 and 175 each have a multisided driver end dimensioned and configured to be received in socket 21 in a fitting relationship. One of drivers 169, 171, 173 and 175, when received in socket 21, is used to drive a fastener by the manual rotation of pocket driver tool 10 about longitudinal axis L. The fitting relationship prevents the rotation of the driver with respect to multisided socket 21.

A tool magnet 181 is provided at an interior closed end of socket 21 in order to releasably hold ferromagnetic drivers 169, 171, 173 and 175, respectively, held in socket 21. The foregoing drivers can easily be removed from storage compartment 8 and held in socket 21, and likewise be removed from socket 21 by the user of pocket tool 10.

Housing bottom 5 is attached to housing top 3 by means of housing screws 183 which are inserted in screw holes in each of screw bosses 33 and 35 in housing top 3, and screw bosses 129 and 131 in housing bottom 5. A quick clip 185 or other key ring can be inserted through key ring orifice 27.

Pocket driver tool 10 is extremely flat and hence easy to store. Battery compartments 95 hold cell batteries C in a general plane parallel with the flat faces 12 and 53 of housing top 3 and tool door 7, and flat face 77 of housing bottom 5, with their imaginary central longitudinal axes in an imaginary plane perpendicular to an imaginary plane incorporating longitudinal axis L and perpendicular to flat faces 12, 53 and 77. Drivers 169, 171, 173 and 175 extend across tool compartment 8, and are short enough as described above to render pocket driver tool 10 to have a short width between side walls 15 and 17. Since parts to be held by pocket driver tool 10 are the latter drivers, and since their respective widths are of a small dimension as noted above, the thickness of tool 10 is also small enough to assist in making tool 10 easy to store. Likewise the length of tool 10 between opposing curved end walls 19 and 25 is very small as well. In the preferred embodiment of the invention, pocket driver tool 10 has a width w of 33.133 mm (or about 1.3 inches), a length l of 65.237 mm (or about 2.6 inches) and a thickness t of 6.350 mm (or about 0.4 inch).

Pocket driver tool 10 is also effective in use. Even though its width is small, a user can insert a driver in socket 21, insert the driver in a screw or other fastener, hold the opposing side walls 15 and 17 with the thumb on one side and index finger on the other side and apply torsion to tool 10 to obtain the desired twisting action. Curved side walls 15 and 17 assist in preventing slipping of the fingers along the latter walls during use. Actuating button 9 can be easily operated with one of the user's fingers while pocket driver tool 10 is in use, possibly requiring an easy manipulation of the user's fingers.

Pocket driver tool 10 is a precision tool, which nevertheless can be made inexpensively for a current retail selling price of less than ten dollars (US). Pocket driver tool 10 is attractive in appearance, and effective and efficient in use.

The invention has been described in detail with particular reference to its preferred embodiment, but variations and modifications within the spirit and scope of the invention may appear to those skilled in the art from the foregoing description and from the appended claims.

We claim:

1. A pocket driver tool for fitting in a user's pocket and the like and for driving a selected fastener at a work place, said pocket driver tool comprising:

a longitudinal housing having a forward socket end portion, a rearward end portion, opposing side walls, and a flat front face generally lying in an imaginary front face plane, a flat rear face, said longitudinal housing comprising:

a multisided socket extending in said forward socket end portion extending along a longitudinal axis, said multisided socket being provided for receiving in a fitting relationship and for preventing from rotation, a driver having a multisided driver end of a driver with respect to said multisided socket; and a series of driver stalls for receiving elongated drivers having respective multisided driver ends for cooperating with said multisided socket for being rotated in response to the rotation of said multisided socket, said series of driver stalls extending transversely to said longitudinal axis between said forward socket end portion and said rearward end portion, and being located between said opposing side walls;

a tool door being movable for selectively covering and closing driver stalls, and for uncovering and opening said driver stalls to enable the withdrawal of one or more drivers from said respective driver stalls and for enabling the putting of drivers in said driver stalls when said respective driver stalls are empty; and a hinge structure interconnecting said tool door to said longitudinal housing for pivotal movement about a tool axis, said tool door axis being perpendicular to said longitudinal axis and lying substantially in the front face plane.

2. A pocket driver tool according to claim 1 and further comprising:

a lumination device having an active condition for emitting illumination at the work place and an inactive condition for not emitting illumination, said illumination device being located at said forward socket end; and an actuating device for selectively putting said illumination device in one of said active condition and said inactive condition.

3. A pocket driver tool according to claim 2 wherein said illumination device comprises a pair of LEDs disposed on opposite sides of said multisided socket.

4. A pocket driver tool according to claim 2 wherein said pocket driver tool is dimensioned to fit in an adult's palm to facilitate rotation of said pocket driver tool with a driver extending from said socket along the longitudinal axis.

5. A pocket driver tool according to claim 4 wherein said pocket driver tool has a length extending between said forward socket end portion and said rearward end portion of about 65 mm, a width between said opposing side walls of about 33 mm and thickness between said front face and said rear face of about 6 mm.

6. A pocket driver tool according to claim 2 wherein said actuating device is disposed on said front face.

7. A pocket driver tool according to claim 6 wherein said actuating device is an actuating button.

8. A pocket driver tool according to claim 2 wherein said illumination device comprises an LED lens on opposite sides of said multisided socket.

9. A pocket driver tool according to claim 1 wherein each of said front face and said rear face are generally flat.

10. A pocket driver tool according to claim 1 wherein said housing comprises a housing top and a housing bottom;

said housing top comprising:

a housing top flat front face;

opposing top side walls extending perpendicularly from said flat front face;

a housing top forward end wall extending between said opposing side walls and including a forwardly extending nose portion generally perpendicular to said opposing sidewalls, said forward housing top end wall including said forward socket end portion and having an upper socket portion of said multisided socket extending along said longitudinal axis;

opposing housing top side walls extending rearwardly between said respective opposing top side walls; and a housing top rearward section extending between said opposing housing top side walls and forwardly from said housing top forward end wall, and being generally coplanar with said housing flat front face, said housing top rearward section and said flat front face defining therebetween a tool storage opening;

wherein said housing top forward end wall interconnects said opposing housing top side walls, and said tool door is movable to selectively open and close said tool storage opening.

11. A pocket driver tool according to claim 10 wherein said housing top further comprises:

an actuating button orifice disposed in said flat front face.

12. A pocket driver tool according to claim 10 wherein said housing bottom comprises:

a housing bottom flat back base in a parallel, opposing relationship with said housing top front face, said housing top rearward section and said tool door;

opposing housing bottom side walls extending perpendicularly from said housing bottom flat back base;

a set of driver stalls extending between said housing opposing bottom side walls for receiving respective drivers.

13. A pocket driver tool according to claim 12 wherein said longitudinal axis is a central longitudinal axis extending along the middle of said pocket driver too, and wherein said housing bottom further comprises:

a housing bottom forward end wall perpendicular to said housing bottom flat back base and extending between said opposing housing bottom side walls, said housing bottom forward end wall cooperating with said housing top forward end wall to form a continuous forward pocket driver tool forward end wall;

a lower socket portion extending rearwardly from said housing bottom forward end wall in an opposing relationship with said upper socket portion along said central longitudinal axis, said lower socket portion and said upper socket portion cooperating to form said multisided socket.

14. A pocket driver tool according to claim 13 and further including a set of parallel driver stall walls extending transversely to said longitudinal axis and between said housing bottom side walls to form said driver stalls.

15. A pocket driver tool according to claim 14 and further comprising:

a lumination device for emitting illumination at the work place, said illumination device being located at said forward socket end;

said parallel driver walls include a forward driver stall end wall proximate said housing bottom forward end wall; and at least one battery cell compartment disposed between said forward driver stall end wall and said housing bottom forward end wall, and an electrical connection connecting at least one battery cell in said at least one battery cell compartment and said illumination device.

16. A pocket driver tool according to claim 15 wherein said at least one battery cell compartment comprises a pair of battery cell compartments disposed symmetrically on opposites sides of said central longitudinal axis; and wherein said flat back base includes a battery door orifice extending across said battery cell compartment and being disposed symmetrically across said central longitudinal axis; and wherein said pocket driver tool further comprises:

a battery door for selectively and alternatively closing said battery door orifice to close said battery compartments and to open said bottom compartments to provide access thereto.

17. A pocket driver tool according to claim 16 wherein said housing bottom flat back base lies in a general plane, said battery cell compartments are configured to hold cell batteries in a general plane parallel with said general plane of said housing bottom flat back base.

18. A pocket driver tool according to claim 15 wherein said parallel driver walls include a rearward driver stall end wall proximate said housing bottom rearward end wall; and wherein said pocket driver tool further comprises:

a rearward end portion disposed rearwardly of said rearward driver stall end wall, and a housing key ring-receiving orifice.

19. A pocket driver tool according to claim 1 wherein said opposing side walls are generally flat and outwardly flared to render them ergonomic as said pocket driver tool is used to drive a fastener.

20. A pocket driver tool according to claim 1, and further including a set of drivers, each of said drivers having a multisided driver end for being received in a fitting relationship in said multisided socket, and each of said set of drivers being dimensioned and configured to fit in respective driver stalls for storage.

21. A pocket driver tool according to claim 1 wherein said multisided socket has a hexagonal cross section.

22. A pocket driver tool according to claim 1 wherein said multisided socket has an interior closed end, and said pocket driver tool further comprises a tool magnet located in said closed end.

23. A pocket driver tool according to claim 1 wherein said tool door axis is proximate said rearward end portion.

24. A pocket driver tool comprising:

a housing having a central longitudinal axis extending along the middle of said pocket driver tool, and wherein said housing has the general shape of a rectangular parallelepiped, said housing comprising:

opposing side walls on opposite sides of said central longitudinal axis, each side wall including a forward end portion and an opposing rearward end portion; a forward wall and a rearward end wall respectively connecting the opposing end portions of said opposing side walls;

a flat front face partially covering a front of said pocket driver tool; and a flat back base of said pocket driver tool;

a hexagonal socket in said forward end portion extending along said central longitudinal axis as the longitudinal axis of said hexagonal socket;

a lighting assembly for emitting light from said forward end portion;

a driver storage compartment for storing drivers for being rotated with said hexagonal socket in response to rotation of said pocket driver tool about the central longitudinal axis, said driver storage compartment having driver stalls extending transversely to said central longitudinal axis;

a tool door pivotable about an axis transverse to said longitudinal axis for opening and closing access to said driver storage compartment, said tool door cooperating with said flat front face of said housing to cover the remaining front of said pocket driver tool;

a battery compartment within said housing for holding batteries to provide electrical power to said lighting assembly;

a door on said flat back base for selectively providing access to said battery compartment; and an actuating button located on said flat front face for selectively closing an electrical contact between batteries in said battery compartment to activate or deactivate said lighting assembly.

* * * * *